US010577166B2

(12) United States Patent
Barrows et al.

(10) Patent No.: US 10,577,166 B2
(45) Date of Patent: Mar. 3, 2020

(54) PACKAGING FOR AN ACTIVE CONTACT LENS

(71) Applicant: Verily Life Sciences LLC, Mountain View, CA (US)

(72) Inventors: Daniel Patrick Barrows, Sunnyvale, CA (US); Jeffrey George Linhardt, Pleasanton, CA (US)

(73) Assignee: Verily Life Sciences LLC, Mountain View, CA (US)

( * ) Notice: Subject to any disclaimer, the term of this patent is extended or adjusted under 35 U.S.C. 154(b) by 246 days.

(21) Appl. No.: 15/614,020

(22) Filed: Jun. 5, 2017

(65) Prior Publication Data

US 2017/0267430 A1 Sep. 21, 2017

Related U.S. Application Data

(62) Division of application No. 14/133,750, filed on Dec. 19, 2013, now Pat. No. 9,701,458.

(51) Int. Cl.
*B65D 81/22* (2006.01)

(52) U.S. Cl.
CPC ..... *B65D 81/22* (2013.01); *B65D 2585/545* (2013.01)

(58) Field of Classification Search
CPC . B65D 2585/545; A45C 11/05; A45C 11/045; A45C 2011/006; B65B 25/008; B65B 55/10; B65B 55/18; B65B 55/22; B65B 47/00
USPC ..... 206/5, 5.1; 53/426, 431, 453, 471
See application file for complete search history.

(56) References Cited

U.S. PATENT DOCUMENTS

| | | | |
|---|---|---|---|
| 3,054,412 | A | 9/1962 | Nickell |
| 3,089,500 | A | 5/1963 | Stalcup |
| 3,186,540 | A | 6/1965 | Breger |
| 3,268,068 | A | 8/1966 | Le Grand |
| 3,298,502 | A | 1/1967 | Schwartzman |
| 3,311,229 | A | 3/1967 | Troll |

(Continued)

FOREIGN PATENT DOCUMENTS

| | | | |
|---|---|---|---|
| EP | 2620802 | A1 | 7/2013 |
| WO | 2008053220 | A1 | 5/2008 |

OTHER PUBLICATIONS

International Search Report issued in connection with International Application No. PCT/US2014/062781 dated Feb. 9, 2015.

(Continued)

*Primary Examiner* — Hemant Desai
*Assistant Examiner* — Jacob A Smith
(74) *Attorney, Agent, or Firm* — McDonnell Boehnen Hulbert & Berghoff LLP

(57) ABSTRACT

An eye-mountable device, having an anterior convex side and a posterior concave side, is packaged in a container having a base and a wall. The wall extends from the base and defines an opening of the container. Disposed within the container is a pedestal, which has a first end attached to the base of the container and a second end opposite the first end. The eye-mountable device is mounted on the pedestal such that the posterior concave side contacts the second end of the pedestal and the eye-mountable device is elevated from the base of the container. The opening of the container can be sealed by a lidstock.

11 Claims, 7 Drawing Sheets

(56) References Cited

U.S. PATENT DOCUMENTS

D210,248 S 2/1968 Nissel
3,770,113 A 11/1973 Thomas
3,822,780 A * 7/1974 Ulmer ..... A45C 11/005 206/5.1
3,977,517 A 8/1976 Kadlecik
3,990,579 A 11/1976 Manning
4,091,917 A * 5/1978 Clawson ..... A45C 11/005 134/137
4,228,136 A 10/1980 Thomas
4,392,569 A 7/1983 Shoup
4,406,362 A 9/1983 Thomas
4,543,882 A * 10/1985 Ryder ..... B41F 17/006 101/114
4,697,703 A 10/1987 Will
4,736,836 A 4/1988 Alongi
4,807,750 A 2/1989 Ryder
4,817,789 A 4/1989 Paul
4,928,815 A 5/1990 Paul
5,199,559 A 4/1993 Dark
5,280,834 A * 1/1994 Berkley ..... A45C 11/005 116/309
D358,029 S 5/1995 Abrams
5,418,022 A 5/1995 Anderson
5,452,792 A 9/1995 Zautke
5,474,169 A 12/1995 Bauman
5,515,964 A 5/1996 Bauman
5,573,108 A 11/1996 Hamilton
5,657,506 A 8/1997 Pankow
5,695,049 A 12/1997 Bauman
6,029,808 A 2/2000 Peck
6,050,398 A 4/2000 Wilde
6,120,460 A * 9/2000 Abreu ..... A61B 3/1241 600/405
6,164,044 A * 12/2000 Porfano ..... B65B 55/10 422/28
D435,966 S 1/2001 Duis
D441,284 S 5/2001 Saur
6,289,907 B1 9/2001 Horian
D458,023 S 6/2002 Dzwill
6,435,339 B1 8/2002 Kroupa
6,681,127 B2 1/2004 March
7,086,526 B2 8/2006 Newman
7,225,919 B2 6/2007 Hamilton
7,281,699 B2 10/2007 Hovey
D556,602 S 12/2007 Clements
D556,603 S 12/2007 Barnes
7,311,194 B2 12/2007 Jin
D559,706 S 1/2008 Clements
D571,555 S 6/2008 Maraia
7,426,993 B2 9/2008 Coldrey
7,628,269 B2 12/2009 O'Hara
7,699,161 B2 4/2010 Tokarski
7,699,162 B2 4/2010 Tokarski
7,819,241 B2 10/2010 Post-Smith
7,832,551 B2 11/2010 Newman
7,938,255 B2 * 5/2011 Newman ..... A45C 11/005 206/5.1
7,967,133 B2 * 6/2011 Newman ..... A45C 11/005 206/5.1
8,251,205 B2 8/2012 Azera
8,281,557 B2 * 10/2012 Doshi ..... B26F 1/02 128/207.18
8,881,892 B1 11/2014 Linhardt
9,701,458 B2 7/2017 Barrows et al.
2001/0017271 A1 * 8/2001 Yavitz ..... A45C 11/005 206/5.1
2004/0027536 A1 2/2004 Blum
2006/0054514 A1 3/2006 Tokarski
2006/0134169 A1 6/2006 Linhardt
2006/0145371 A1 7/2006 Lawton
2006/0213783 A1 9/2006 Tokarski
2007/0089998 A1 4/2007 Tokarski
2009/0121370 A1 5/2009 Barrows
2009/0127726 A1 5/2009 Spalding
2009/0166904 A1 7/2009 Lawton
2009/0171459 A1 7/2009 Linhardt
2009/0173045 A1 * 7/2009 Lai ..... A61L 12/086 53/431
2010/0039612 A1 * 2/2010 Levinson ..... B29D 11/00134 351/159.33
2010/0069522 A1 3/2010 Linhardt
2010/0106128 A1 4/2010 Mao
2010/0113901 A1 5/2010 Zhang
2010/0259719 A1 10/2010 Sabeta
2012/0177576 A1 7/2012 Hu
2012/0227360 A1 * 9/2012 Scalzo ..... A61B 17/06114 53/431
2012/0245444 A1 9/2012 Otis
2013/0075282 A1 * 3/2013 Cinader, Jr. ..... A61C 7/14 206/63.5
2013/0104501 A1 * 5/2013 Valaie ..... A61L 2/26 53/425
2013/0180999 A1 * 7/2013 Denning ..... A61J 1/14 220/625
2013/0233736 A1 * 9/2013 Hess ..... A61F 2/0095 206/210
2013/0281774 A1 10/2013 Honaryar
2014/0197558 A1 7/2014 Linhardt
2015/0001072 A1 1/2015 Liu
2015/0001073 A1 1/2015 Liu
2015/0004058 A1 1/2015 Yao
2015/0005602 A1 1/2015 Linhardt
2015/0005603 A1 1/2015 Liu
2015/0173602 A1 6/2015 Barrows
2015/0183173 A1 7/2015 Linhardt
2016/0200461 A1 * 7/2016 Broadbent ..... B65B 7/28 53/426

OTHER PUBLICATIONS

Written Opinion issued in connection with International Application No. PCT/US2014/062781 dated Feb. 9, 2015.

* cited by examiner

PACKAGING FOR AN ACTIVE CONTACT LENS

CROSS-REFERENCE TO RELATED APPLICATIONS

This is a division of U.S. patent application Ser. No. 14/133,750, filed Dec. 19, 2013, which is incorporated herein by reference.

BACKGROUND

An eye-mountable device may be configured to obtain health-related information based on at least one analyte detected from an eye of a user wearing the eye-mountable device. Such an eye-mountable device may include a sensor apparatus configured to detect at least one analyte (e.g., glucose). For example, the eye-mountable device may be in the form of a contact lens that includes a sensor apparatus configured to detect the at least one analyte.

SUMMARY

The present disclosure describes embodiments that relate to packaging for an eye-mountable device. In one aspect, the present application describes a package. The package includes a container having a base and a wall, where the wall extends from the base and defines an opening opposite the base. The package also includes a pedestal disposed within the container. The pedestal has a first end and a second end opposite the first end, where the first end is attached to the base of the container. The package further includes an eye-mountable device having an anterior convex side and a posterior concave side opposite the anterior convex side. The eye-mountable device is mounted on the pedestal such that the posterior concave side contacts the second end of the pedestal and the eye-mountable device is elevated from the base of the container. The package also includes a lidstock configured to seal the opening of the container.

In another aspect, the present disclosure describes a method. The method includes providing a container having a base and a wall, where the wall extends from the base and defines an opening opposite the base. The container includes a pedestal that has a first end and a second end opposite the first end, where the first end is attached to the base of the container. The method also includes mounting an eye-mountable device on the pedestal, where the eye-mountable device has an anterior convex side and a posterior concave side opposite the anterior convex. Mounting the eye-mountable device on the pedestal comprises mounting the eye-mountable device such that the posterior concave side contacts the second end of the pedestal and the eye-mountable device is elevated from the base of the container. The method further includes sealing the opening of the container with a lidstock.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
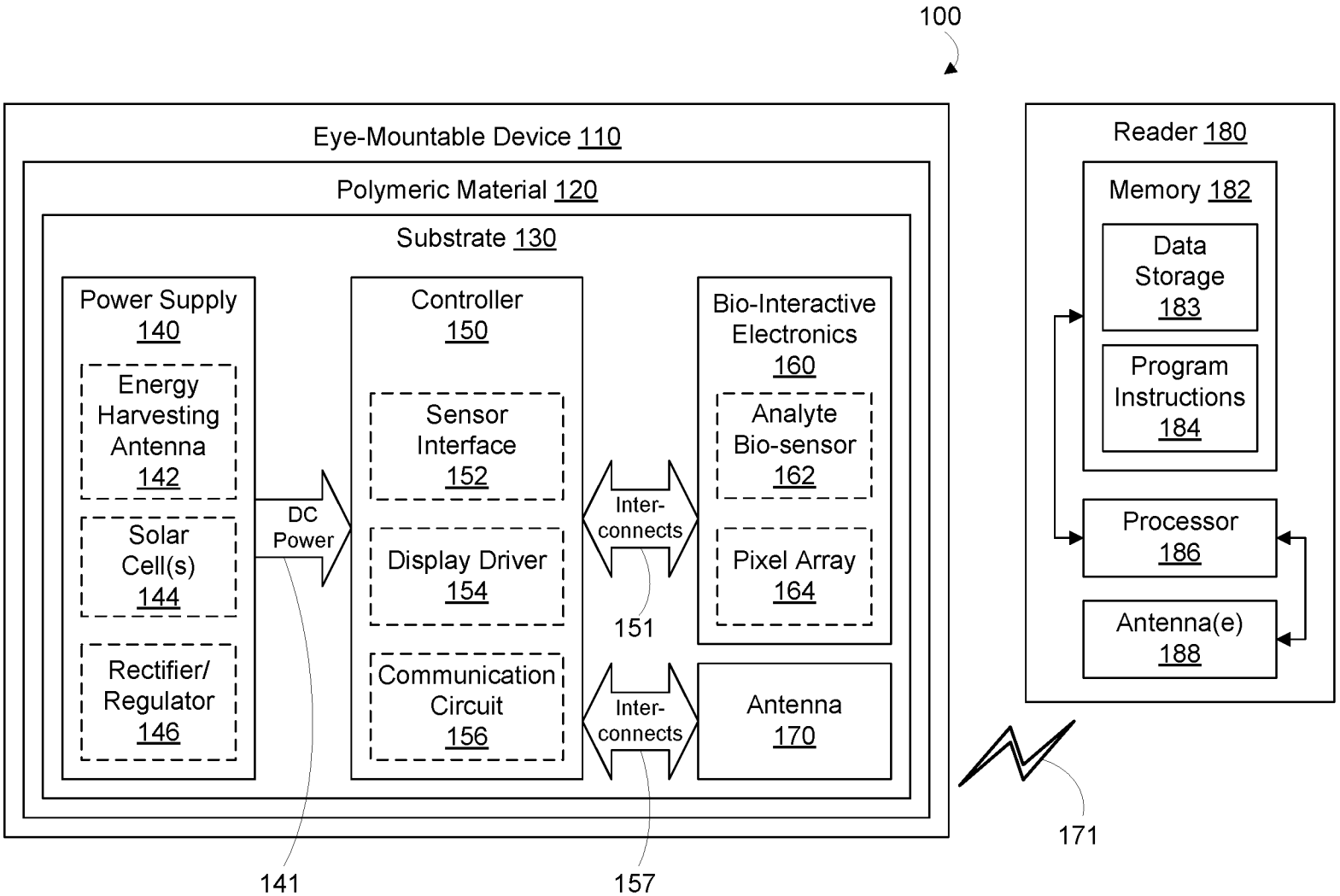
FIG. 1 is a block diagram of an example system that includes an eye-mountable device in wireless communication with a reader, in accordance with an example embodiment.

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

I. OVERVIEW

In an example, an ophthalmic sensing platform can include a sensor, control electronics, and an antenna all situated on a substrate embedded in a polymeric material. The polymeric material can be incorporated in an ophthalmic device, such as an eye-mountable device or an implantable medical device. The control electronics can operate the sensor to perform readings and can operate the antenna to wirelessly communicate the readings from the sensor to any other device the antenna.

In some examples, the polymeric material can be in the form of a round lens with a concave curvature configured to mount to a corneal surface of an eye, such as a contact lens. The substrate can be embedded near the periphery of the polymeric material to avoid interference with incident light received closer to the central region of the cornea. The sensor can be arranged on the substrate to face inward, toward the corneal surface, so as to generate clinically relevant readings from near the surface of the cornea and/or from tear fluid interposed between the polymeric material and the corneal surface. Additionally or alternatively, the sensor can be arranged on the substrate to face outward, away from the corneal surface and toward the layer of tear fluid coating the surface of the polymeric material exposed to the atmosphere. In some examples, the sensor is entirely embedded within the polymeric material. For example, an electrochemical sensor that includes a working electrode and a reference electrode can be embedded in the polymeric material and situated such that the sensor electrodes are less than 10 micrometers from the polymeric surface configured to mount to the cornea. The sensor can generate an output signal indicative of a concentration of an analyte that diffuses through the lens material to the sensor electrodes.

Tear fluid contains a variety of inorganic electrolytes (e.g., $Ca^{2+}$, $Mg^{2+}$, $Cl^{-}$) and organic components (e.g., glucose, lactate, proteins, lipids, etc.) that can be used to diagnose health states. An ophthalmic sensing platform including the above-mentioned sensor can be configured to measure one or more of these analytes can thus provide a convenient non-invasive platform useful in diagnosing and/or monitoring health states. For example, an ophthalmic sensing platform can be configured to sense glucose and can be used by diabetic individuals to measure/monitor their glucose levels. In some examples, the sensor can be configured to measure additional or other conditions other than analyte levels; e.g., the sensor can be configured to measure light, temperature, pressure, etc.

In some examples, an eye-mountable device (e.g., a contact lens) can be packaged in an aqueous solution. However, if the eye-mountable device is active (e.g., contains a biological enzyme), packaging the eye-mountable device in an aqueous solution may cause deterioration of functionality of the active eye-mountable device. For example, if the eye-mountable device contains a biological enzyme, subjecting the device to an aqueous solution may cause the enzyme to deteriorate. Dry packaging may prevent such deterioration. Further, in some examples, the eye-mountable device may be presented to a user in a specific orientation so that it can be handled properly, prepared properly, and to present sensors coupled to the eye-mountable device in a correct orientation to facilitate calibration.

II. EXAMPLE OPHTHALMIC ELECTRONICS PLATFORM

FIG. 1 is a block diagram of a system 100 that includes an eye-mountable device 110 in wireless communication with a reader 180. The exposed regions of the eye-mountable device 110 are made of a polymeric material 120 formed to be contact-mounted to a corneal surface of an eye. A substrate 130 is embedded in the polymeric material 120 to provide a mounting surface for a power supply 140, a controller 150, bio-interactive electronics 160, and a communication antenna 170. The bio-interactive electronics 160 are operated by the controller 150. The power supply 140 supplies operating voltages to the controller 150 and/or the bio-interactive electronics 160. The antenna 170 is operated by the controller 150 to communicate information to and/or from the eye-mountable device 110. The antenna 170, the controller 150, the power supply 140, and the bio-interactive electronics 160 can all be situated on the embedded substrate 130. Because the eye-mountable device 110 includes electronics and is configured to be contact-mounted to an eye, it is also referred to herein as an ophthalmic electronics platform.

To facilitate contact-mounting, the polymeric material 120 can have a concave surface configured to adhere ("mount") to a moistened corneal surface (e.g., by capillary forces with a tear-film coating the corneal surface). Additionally or alternatively, the eye-mountable device 110 can be adhered by a vacuum force between the corneal surface and the polymeric material due to the concave curvature. While mounted with the concave surface against the eye, the outward-facing surface of the polymeric material 120 can have a convex curvature that is formed to not interfere with eye-lid motion while the eye-mountable device 110 is mounted to the eye. For example, the polymeric material 120 can be a substantially transparent curved polymeric disk shaped similarly to a contact lens.

The polymeric material 120 can include one or more biocompatible materials, such as those employed for use in contact lenses or other ophthalmic applications involving direct contact with the corneal surface. The polymeric material 120 can optionally be formed in part from such biocompatible materials or can include an outer coating with such biocompatible materials. The polymeric material 120 can include materials configured to moisturize the corneal surface, such as hydrogels and the like. In some examples, the polymeric material 120 can be a deformable ("non-rigid") material to enhance wearer comfort. In some examples, the polymeric material 120 can be shaped to provide a predetermined, vision-correcting optical power, such as can be provided by a contact lens.

The substrate 130 includes one or more surfaces suitable for mounting the bio-interactive electronics 160, the controller 150, the power supply 140, and the antenna 170. The substrate 130 can be employed both as a mounting platform for chip-based circuitry (e.g., by flip-chip mounting to connection pads) and/or as a platform for patterning conductive materials (e.g., gold, platinum, palladium, titanium, copper, aluminum, silver, metals, other conductive materials, combinations of these, etc.) to create electrodes, interconnects, connection pads, antennae, etc. In some examples, substantially transparent conductive materials (e.g., indium tin oxide) can be patterned on the substrate 130 to form circuitry, electrodes, etc. For example, the antenna 170 can be formed by forming a pattern of gold or another conductive material on the substrate 130 by deposition, photolithography, electroplating, etc. Similarly, interconnects 151, 157 between the controller 150 and the bio-interactive electronics 160, and between the controller 150 and the antenna 170, respectively, can be formed by depositing suitable patterns of conductive materials on the substrate 130. A combination of microfabrication techniques including, without limitation, the use of photoresists, masks, deposition techniques, and/or plating techniques can be employed to pattern materials on the substrate 130. The substrate 130 can be a relatively rigid material, such as polyethylene terephthalate ("PET") or another material configured to structurally support the circuitry and/or chip-based electronics within the polymeric material 120. The eye-mountable device 110 can alternatively be arranged with a group of unconnected substrates rather than a single substrate. For example, the controller 150 and a bio-sensor or other bio-interactive electronic component can be mounted to one substrate, while the antenna 170 is mounted to another substrate and the two can be electrically connected via the interconnects 157.

In some examples, the bio-interactive electronics 160 (and the substrate 130) can be positioned away from the center of the eye-mountable device 110 and thereby avoid interference with light transmission to the central, light-sensitive region of the eye. For example, where the eye-mountable device 110 is shaped as a concave-curved disk, the substrate 130 can be embedded around the periphery (e.g., near the outer circumference) of the disk. In some examples, however, the bio-interactive electronics 160 (and the substrate 130) can be positioned in or near the central region of the eye-mountable device 110. Additionally or alternatively, the bio-interactive electronics 160 and/or substrate 130 can be substantially transparent to incoming visible light to mitigate interference with light transmission to the eye. Moreover, in some examples, the bio-interactive electronics 160 can include a pixel array 164 that emits and/or transmits light to be received by the eye according to display instructions. Thus, the bio-interactive electronics 160 can optionally be positioned in the center of the eye-mountable device so as to generate perceivable visual cues to a wearer of the eye-mountable device 110, such as by displaying information (e.g., characters, symbols, flashing patterns, etc.) on the pixel array 164.

In examples, the substrate 130 can be ring-shaped with a radial width dimension sufficient to provide a mounting platform for the embedded electronics components. The substrate 130 can have a thickness sufficiently small to allow the substrate 130 to be embedded in the polymeric material 120 without influencing the profile of the eye-mountable device 110. The substrate 130 can have a thickness sufficiently large to provide structural stability suitable for supporting the electronics mounted thereon. For example, the substrate 130 can be shaped as a ring with a diameter of about 10 millimeters, a radial width of about 1 millimeter (e.g., an outer radius 1 millimeter larger than an inner radius), and a thickness of about 50 micrometers. The substrate 130 can optionally be aligned with the curvature of the eye-mounting surface of the eye-mountable device 110 (e.g., convex surface). For example, the substrate 130 can be shaped along the surface of an imaginary cone between two circular segments that define an inner radius and an outer radius. In such an example, the surface of the substrate 130 along the surface of the imaginary cone defines an inclined surface that is approximately aligned with the curvature of the eye mounting surface at that radius.

In examples, the power supply 140 may be configured to harvest ambient energy to power the controller 150 and the bio-interactive electronics 160. For example, a radio-frequency energy-harvesting antenna 142 can capture energy from incident radio radiation. Additionally or alternatively, solar cell(s) 144 ("photovoltaic cells") can capture energy from incoming ultraviolet, visible, and/or infrared radiation. Furthermore, an inertial power scavenging system can be included to capture energy from ambient vibrations. The energy harvesting antenna 142 can optionally be a dual-purpose antenna that is also used to communicate information to/from the reader 180. That is, the functions of the communication antenna 170 and the energy harvesting antenna 142 can be accomplished with the same physical antenna.

A rectifier/regulator 146 can be used to condition the captured energy to a stable DC supply voltage 141 that is supplied to the controller 150. For example, the energy harvesting antenna 142 can receive incident radio frequency radiation. Varying electrical signals on the leads of the antenna 142 are output to the rectifier/regulator 146. The rectifier/regulator 146 rectifies the varying electrical signals to a DC voltage and regulates the rectified DC voltage to a level suitable for operating the controller 150. Additionally or alternatively, output voltage from the solar cell(s) 144 can be regulated to a level suitable for operating the controller 150. The rectifier/regulator 146 can include one or more energy storage devices to mitigate high frequency variations in the ambient energy gathering antenna 142 and/or solar cell(s) 144. For example, one or more energy storage devices (e.g., a capacitor, an inductor, etc.) can be connected in parallel across the outputs of the rectifier 146 to regulate the DC supply voltage 141 and configured to function as a low-pass filter.

The controller 150 is turned on when the DC supply voltage 141 is provided to the controller 150, and the logic in the controller 150 operates the bio-interactive electronics 160 and the antenna 170. The controller 150 can include logic circuitry configured to operate the bio-interactive electronics 160 so as to interact with a biological environment of the eye-mountable device 110. The interaction could involve the use of one or more components, such an analyte bio-sensor 162, in bio-interactive electronics 160 to obtain input from the biological environment. Additionally or alternatively, the interaction could involve the use of one or more components, such as pixel array 164, to provide an output to the biological environment.

In one example, the controller 150 includes a sensor interface module 152 that is configured to operate analyte bio-sensor 162. The analyte bio-sensor 162 can be, for example, an amperometric electrochemical sensor that includes a working electrode and a reference electrode. A voltage can be applied between the working and reference electrodes to cause an analyte to undergo an electrochemical reaction (e.g., a reduction and/or oxidation reaction) at the working electrode. The electrochemical reaction can generate an amperometric current that can be measured through the working electrode. The amperometric current can be dependent on the analyte concentration. Thus, the amount of the amperometric current that is measured through the working electrode can provide an indication of analyte concentration. In some examples, the sensor interface module 152 can be a potentiostat configured to apply a voltage difference between the working and reference electrodes of the amperometric electrochemical sensor while measuring a current through the working electrode.

In some instances, a reagent can also be included to sensitize the electrochemical sensor to one or more desired analytes. The reagent may be localized proximate the electrochemical sensor so as to selectively react with an analyte in a tear-film. In one example, the reagent may include a biological enzyme. In another example, a layer of glucose oxidase ("GOx") proximal to the working electrode can catalyze glucose oxidation to generate hydrogen peroxide ($H_2O_2$). The hydrogen peroxide can then be electro-oxidized at the working electrode, which releases electrons to the working electrode, resulting in an amperometric current that can be measured through the working electrode.

$$\text{glucose} + O_2 \xrightarrow{\text{GOx}} H_2O_2 + \text{gluconolactone}$$
$$H_2O_2 \longrightarrow 2H^+ + O_2 + 2e^-$$

The current generated by either reduction or oxidation reactions is approximately proportionate to the reaction rate. Further, the reaction rate is dependent on the rate of analyte molecules reaching the electrochemical sensor electrodes to fuel the reduction or oxidation reactions, either directly or catalytically through a reagent. In a steady state, where analyte molecules diffuse to the electrochemical sensor electrodes from a sampled region at approximately the same rate that additional analyte molecules diffuse to the sampled region from surrounding regions, the reaction rate is approximately proportionate to the concentration of the analyte molecules. The current measured through the working electrode thus provides an indication of the analyte concentration.

The controller 150 can optionally include a display driver module 154 for operating a pixel array 164. The pixel array 164 can be an array of separately programmable light transmitting, light reflecting, and/or light emitting pixels arranged in rows and columns. The individual pixel circuits can optionally include liquid crystal technologies, microelectromechanical technologies, emissive diode technologies, etc. to selectively transmit, reflect, and/or emit light according to information from the display driver module 154. Such a pixel array 164 can also optionally include more than one color of pixels (e.g., red, green, and blue pixels) to render visual content in color. The display driver module 154 can include, for example, one or more data lines providing programming information to the separately programmed pixels in the pixel array 164 and one or more addressing lines for setting groups of pixels to receive such programming information. Such a pixel array 164 situated on the eye can also include one or more lenses to direct light from the pixel array to a focal plane perceivable by the eye.

The controller 150 can also include a communication circuit 156 for sending and/or receiving information via the antenna 170. The communication circuit 156 can optionally include one or more oscillators, mixers, frequency injectors, etc. to modulate and/or demodulate information on a carrier frequency to be transmitted and/or received by the antenna 170. In some examples, the eye-mountable device 110 is configured to indicate an output from a bio-sensor by modulating an impedance of the antenna 170 in a manner that is perceivable by the reader 180. For example, the communication circuit 156 can cause variations in the amplitude, phase, and/or frequency of backscatter radiation from the antenna 170, and such variations can be detected by the reader 180.

The controller 150 is connected to the bio-interactive electronics 160 via interconnects 151. For example, where the controller 150 includes logic elements implemented in an integrated circuit to form the sensor interface module 152 and/or display driver module 154, a patterned conductive material (e.g., gold, platinum, palladium, titanium, copper, aluminum, silver, metals, combinations of these, etc.) can connect a terminal on the chip to the bio-interactive electronics 160. Similarly, the controller 150 is connected to the antenna 170 via interconnects 157.

It is noted that the block diagram shown in FIG. 1 is described in connection with functional modules for convenience in description. However, embodiments of the eye-mountable device 110 can be arranged with one or more of the functional modules ("sub-systems") implemented in a single chip, integrated circuit, and/or physical component. For example, while the rectifier/regulator 146 is illustrated in the power supply block 140, the rectifier/regulator 146 can be implemented in a chip that also includes the logic elements of the controller 150 and/or other features of the embedded electronics in the eye-mountable device 110. Thus, the DC supply voltage 141 that is provided to the controller 150 from the power supply 140 can be a supply voltage that is provided to components on a chip by rectifier and/or regulator components located on the same chip. That is, the functional blocks in FIG. 1 shown as the power supply block 140 and controller block 150 need not be implemented as physically separated modules. Moreover, one or more of the functional modules described in FIG. 1 can be implemented by separately packaged chips electrically connected to one another.

Additionally or alternatively, the energy harvesting antenna 142 and the communication antenna 170 can be implemented with the same physical antenna. For example, a loop antenna can both harvest incident radiation for power generation and communicate information via backscatter radiation.

The reader 180 can be configured to be external to the eye; i.e., is not part of the eye-mountable device 110. Reader 180 can include one or more antennae 188 to send and receive wireless signals 171 to and from the eye-mountable device 110. In some examples, reader 180 can communicate using hardware and/or software operating according to one or more standards, such as, but not limited to, a RFID standard, a Bluetooth standard, a Wi-Fi standard, a Zigbee standard, etc.

Reader 180 can also include a computing system with a processor 186 in communication with a memory 182. Memory 182 is a non-transitory computer-readable medium that can include, without limitation, magnetic disks, optical disks, organic memory, and/or any other volatile (e.g. RAM) or non-volatile (e.g. ROM) storage system readable by the processor 186. The memory 182 can include a data storage 183 to store indications of data, such as sensor readings (e.g., from the analyte bio-sensor 162), program settings (e.g., to adjust behavior of the eye-mountable device 110 and/or reader 180), etc. The memory 182 can also include program instructions 184 for execution by the processor 186 to cause the reader 180 to perform processes specified by the instructions 184. For example, the program instructions 184 can cause reader 180 to provide a user interface that allows for retrieving information communicated from the eye-mountable device 110 (e.g., sensor outputs from the analyte bio-sensor 162). The reader 180 can also include one or more hardware components for operating the antenna 188 to send and receive the wireless signals 171 to and from the eye-mountable device 110. For example, oscillators, frequency injectors, encoders, decoders, amplifiers, filters, etc. can drive the antenna 188 according to instructions from the processor 186.

In some examples, reader 180 can be a smart phone, digital assistant, or other portable computing device with wireless connectivity sufficient to provide the wireless communication link 171. In other examples, reader 180 can be implemented as an antenna module that can be plugged in to a portable computing device; e.g., in scenarios where the communication link 171 operates at carrier frequencies not commonly employed in portable computing devices. In still other examples, the reader 180 can be a special-purpose device configured to be worn relatively near a wearer's eye to allow the wireless communication link 171 to operate with a low power budget. For example, the reader 180 can be integrated in eyeglasses, integrated in a piece of jewelry such as a necklace, earring, etc., integrated in an article of clothing worn near the head, such as a hat, headband, etc., or integrated in a head-mounted display device.

In an example where the eye-mountable device 110 includes an analyte bio-sensor 162, the system 100 can be operated to monitor the analyte concentration in tear-film on the surface of the eye. Thus, the eye-mountable device 110 can be configured as a platform for an ophthalmic analyte bio-sensor. The tear-film is an aqueous layer secreted from the lacrimal gland to coat the eye. The tear-film is in contact with the blood supply through capillaries in the structure of the eye and includes many biomarkers found in blood that are analyzed to characterize a person's health condition(s). For example, the tear-film includes glucose, calcium, sodium, cholesterol, potassium, other biomarkers, etc. The biomarker concentrations in the tear-film can be systematically different than the corresponding concentrations of the biomarkers in the blood, but a relationship between the two concentration levels can be established to map tear-film biomarker concentration values to blood concentration levels. For example, the tear-film concentration of glucose can be established (e.g., empirically determined) to be approximately one tenth the corresponding blood glucose concentration. However, any other ratio relationship and/or a non-ratio relationship may be used. Thus, measuring tear-film analyte concentration levels provides a non-invasive technique for monitoring biomarker levels in comparison to blood sampling techniques performed by lancing a volume of blood to be analyzed outside a person's body. Moreover, the ophthalmic analyte bio-sensor platform disclosed here can be operated substantially continuously to enable real time monitoring of analyte concentrations.

To perform a reading with the system 100 configured as a tear-film analyte monitor, the reader 180 can emit radio frequency radiation 171 that is harvested to power the eye-mountable device 110 via the power supply 140. Radio frequency electrical signals captured by the energy harvesting antenna 142 (and/or the communication antenna 170) are rectified and/or regulated in the rectifier/regulator 146 and a regulated DC supply voltage 141 is provided to the controller 150. The radio frequency radiation 171 thus turns on the electronic components within the eye-mountable device 110. Once turned on, the controller 150 operates the analyte bio-sensor 162 to measure an analyte concentration level. For example, the sensor interface module 152 can apply a voltage between a working electrode and a reference electrode in the analyte bio-sensor 162. The applied voltage can be sufficient to cause the analyte to undergo an electrochemical reaction at the working electrode and thereby generate an amperometric current that can be measured through the working electrode. The measured amperometric current can provide the sensor reading ("result") indicative of the analyte concentration. The controller 150 can operate the antenna 170 to communicate the sensor reading back to the reader 180 (e.g., via the communication circuit 156). The sensor reading can be communicated by, for example, modulating an impedance of the communication antenna 170 such that the modulation in impedance is detected by the reader 180. The modulation in antenna impedance can be detected by, for example, backscatter radiation from the antenna 170.

In some examples, the system 100 can operate to non-continuously ("intermittently") supply energy to the eye-mountable device 110 to power the controller 150 and bio-interactive electronics 160. For example, radio frequency radiation 171 can be supplied to power the eye-mountable device 110 long enough to carry out a tear-film analyte concentration measurement and communicate the results. For example, the supplied radio frequency radiation can provide sufficient power to apply a potential between a working electrode and a reference electrode sufficient to induce electrochemical reactions at the working electrode, measure the resulting amperometric current, and modulate the antenna impedance to adjust the backscatter radiation in a manner indicative of the measured amperometric current. In such an example, the supplied radio frequency radiation 171 can be considered an interrogation signal from the reader 180 to the eye-mountable device 110 to request a measurement. By periodically interrogating the eye-mountable device 110 (e.g., by supplying radio frequency radiation 171 to temporarily turn the device on) and storing the sensor results (e.g., via the data storage 183), the reader 180 can accumulate a set of analyte concentration measurements over time without continuously powering the eye-mountable device 110.

Figure 2A:
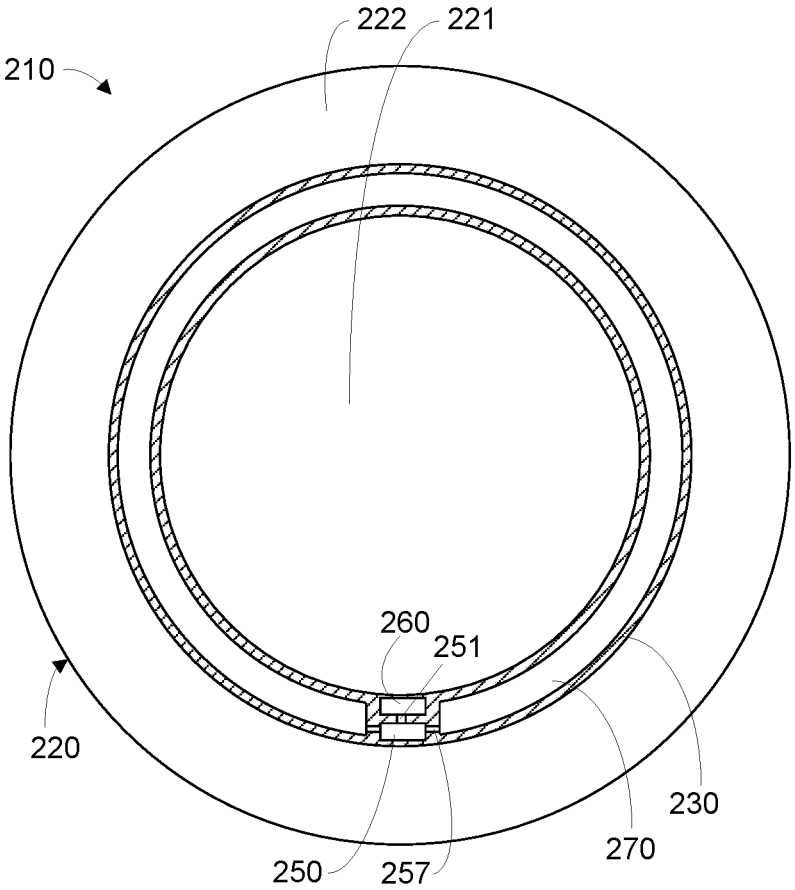
FIG. 2A is a bottom view of an example eye-mountable device, in accordance with an example embodiment.
Figure 2B:
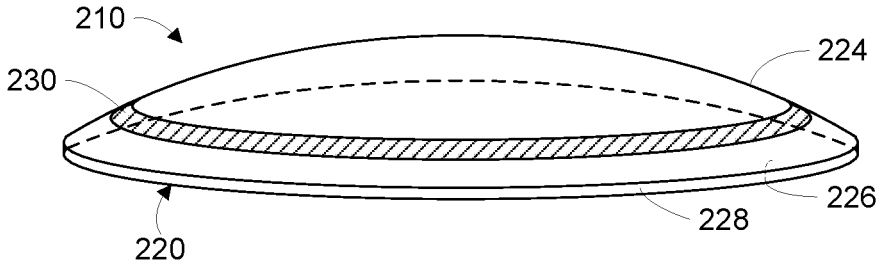
FIG. 2B is a side view of the example eye-mountable device shown in FIG. 2A, in accordance with an example embodiment.

FIG. 2A is a bottom view of an example eye-mountable electronic device 210 (or ophthalmic electronics platform), in accordance with an example embodiment. FIG. 2B is an aspect view of the example eye-mountable electronic device shown in FIG. 2A, in accordance with an example embodiment. It is noted that relative dimensions in FIGS. 2A and 2B are not necessarily to scale, but have been rendered for purposes of explanation only in describing the arrangement of the example eye-mountable electronic device 210. The eye-mountable device 210 is formed of a polymeric material 220 shaped as a curved disk. In some examples, eye-mountable device 210 can include some or all of the above-mentioned aspects of eye-mountable device 110. In other embodiments, eye-mountable device 110 can further include some or all of the herein-mentioned aspects of eye-mountable device 210.

The polymeric material 220 can be a substantially transparent material to allow incident light to be transmitted to the eye while the eye-mountable device 210 is mounted to the eye. The polymeric material 220 can be a biocompatible material similar to those employed to form vision correction and/or cosmetic contact lenses in optometry, such as polyethylene terephthalate ("PET"), polymethyl methacrylate ("PMMA"), polyhydroxyethylmethacrylate ("poly-HEMA"), silicone hydrogels, combinations of these, etc. The polymeric material 220 can be formed with one side having a concave surface 226 suitable to fit over a corneal surface of an eye. The opposite side of the disk can have a convex surface 224 that does not interfere with eyelid motion while the eye-mountable device 210 is mounted to the eye. A circular outer side edge 228 connects the concave surface 224 and convex surface 226.

The eye-mountable device 210 can have dimensions similar to a vision correction and/or cosmetic contact lenses, such as a diameter of approximately 1 centimeter, and a thickness of about 0.1 to about 0.5 millimeters. However, the diameter and thickness values are provided for explanatory purposes only. In some examples, the dimensions of the eye-mountable device 210 can be selected according to the size and/or shape of the corneal surface of the wearer's eye.

The polymeric material 220 can be formed with a curved shape in a variety of ways. For example, techniques similar to those employed to form vision-correction contact lenses, such as heat molding, injection molding, spin casting, etc. can be employed to form the polymeric material 220. While the eye-mountable device 210 is mounted in an eye, the convex surface 224 faces outward to the ambient environment while the concave surface 226 faces inward, toward the corneal surface. The convex surface 224 can therefore be considered an outer, top surface of the eye-mountable device 210 whereas the concave surface 226 can be considered an inner, bottom surface. The "bottom" view shown in FIG. 2A is facing the concave surface 226. From the bottom view shown in FIG. 2A, an outer periphery 222, near the outer circumference of the curved disk is curved to extend out of the page, whereas the central region 221, near the center of the disk is curved to extend into the page.

A substrate 230 is embedded in the polymeric material 220. The substrate 230 can be embedded to be situated along the outer periphery 222 of the polymeric material 220, away from the central region 221. The substrate 230 does not interfere with vision because it is too close to the eye to be in focus and is positioned away from the central region 221 where incident light is transmitted to the eye-sensing portions of the eye. Moreover, the substrate 230 can be formed of a transparent material to further mitigate effects on visual perception.

The substrate 230 can be shaped as a circular ring (e.g., a disk with a centered hole). The surface of the substrate 230 (e.g., along the radial width) is a platform for mounting electronics such as chips (e.g., via flip-chip mounting) and for patterning conductive materials (e.g., via microfabrication techniques such as photolithography, deposition, plating, etc.) to form electrodes, antenna(e), and/or interconnections. The substrate 230 and the polymeric material 220 can be approximately cylindrically symmetric about a common central axis. The substrate 230 can have, for example, a diameter of about 10 millimeters, a radial width of about 1 millimeter (e.g., an outer radius 1 millimeter greater than an inner radius), and a thickness of about 50 micrometers. However, these dimensions are provided for example purposes only, and in no way limit the present disclosure. The substrate 230 can be implemented in a variety of different form factors, similar to the discussion of the substrate 130 in connection with FIG. 1 above.

A loop antenna 270, controller 250, and bio-interactive electronics 260 are disposed on the embedded substrate 230. The controller 250 can be a chip including logic elements configured to operate the bio-interactive electronics 260 and the loop antenna 270. The controller 250 is electrically connected to the loop antenna 270 by interconnects 257 also situated on the substrate 230. Similarly, the controller 250 is electrically connected to the bio-interactive electronics 260 by an interconnect 251. The interconnects 251, 257, the loop antenna 270, and any conductive electrodes (e.g., for an electrochemical analyte bio-sensor, etc.) can be formed from conductive materials patterned on the substrate 230 by a process for precisely patterning such materials, such as deposition, photolithography, etc. The conductive materials patterned on the substrate 230 can be, for example, gold, platinum, palladium, titanium, carbon, aluminum, copper, silver, silver-chloride, conductors formed from noble materials, metals, combinations of these, etc.

As shown in FIG. 2A, bio-interactive electronics 260 is mounted to a side of the substrate 230 facing the convex surface 224. Where the bio-interactive electronics 260 includes an analyte bio-sensor, for example, mounting such a bio-sensor on the substrate 230 facing the convex surface 224 allows the bio-sensor to sense analyte concentrations in tear-film through a channel 272 (shown in FIGS. 2C and 2D) in the polymeric material 220 to the convex surface 224. In some examples, some electronic components can be mounted on one side of the substrate 230, while other electronic components are mounted to the opposing side, and connections between the two can be made through conductive materials passing through the substrate 230.

In an example, the loop antenna 270 is a layer of conductive material patterned along the flat surface of the substrate 230 to form a flat conductive ring. In some instances, the loop antenna 270 can be formed without making a complete loop. For instances, the loop antenna 270 can have a cutout to allow room for the controller 250 and bio-interactive electronics 260, as illustrated in FIG. 2A. However, the loop antenna 270 can also be arranged as a continuous strip of conductive material that wraps entirely around the flat surface of the substrate 230 one or more times. For example, a strip of conductive material with multiple windings can be patterned on the side of the substrate 230 opposite the controller 250 and bio-interactive electronics 260. Interconnects between the ends of such a wound antenna (e.g., the antenna leads) can then be passed through the substrate 230 to the controller 250.

Figure 2D:
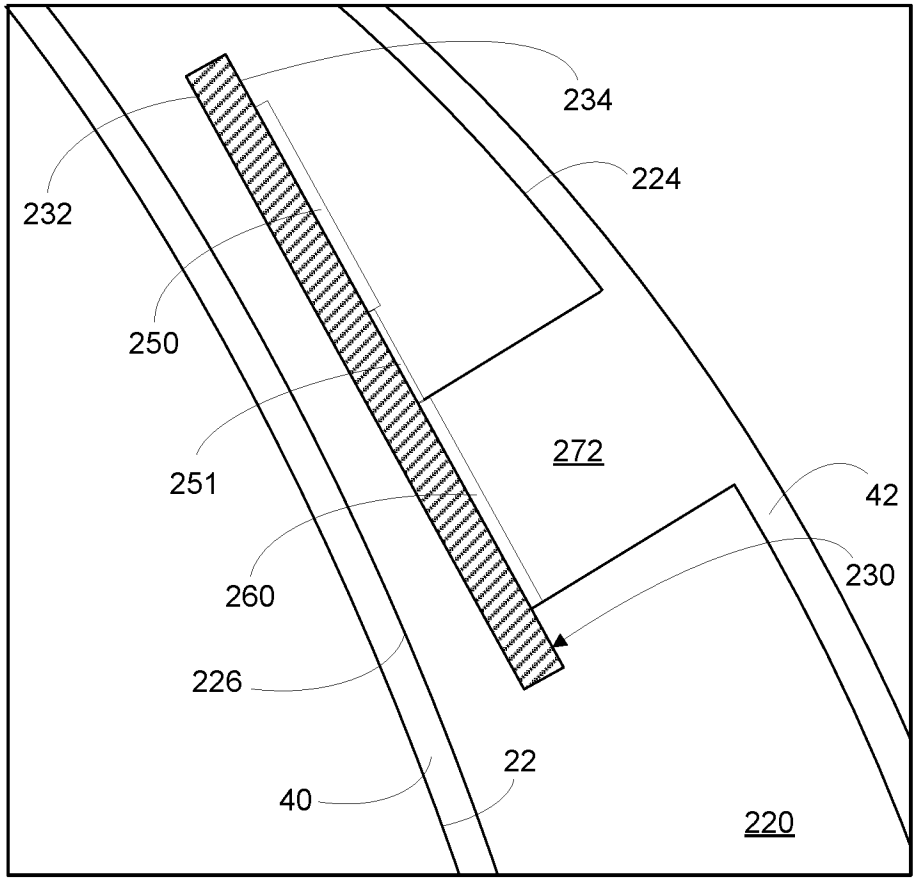
FIG. 2D is a side cross-section view enhanced to show the tear-film layers surrounding the surfaces of the example eye-mountable device when mounted as shown in FIG. 2C, in accordance with an example embodiment.
Figure 2C:
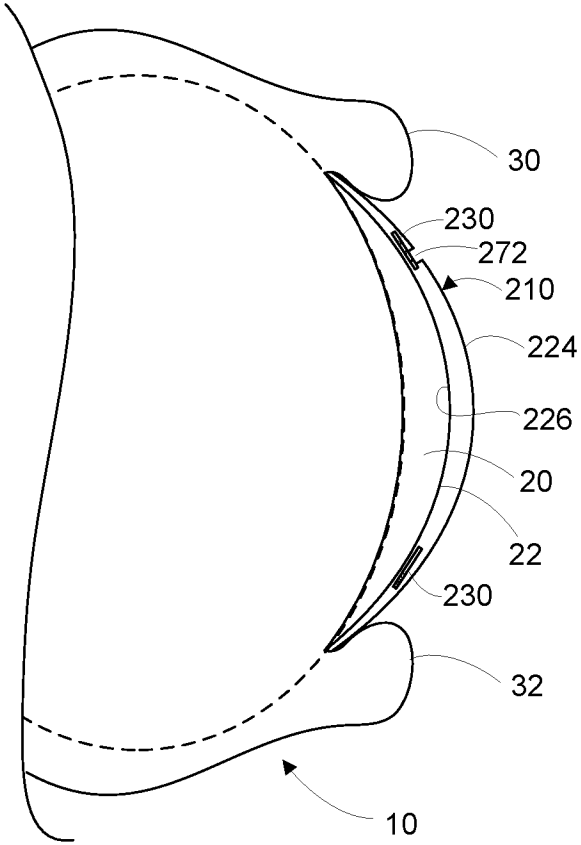
FIG. 2C is a side cross-section view of the example eye-mountable device shown in FIGS. 2A and 2B while mounted to a corneal surface of an eye, in accordance with an example embodiment.

FIG. 2C is a side cross-section view of the example eye-mountable electronic device 210 while mounted to a corneal surface 22 of an eye 10, in accordance with an example embodiment. FIG. 2D is a close-in side cross-section view enhanced to show the tear-film layers 40, 42 surrounding the exposed surfaces 224, 226 of the example eye-mountable device 210, in accordance with an example embodiment. It is noted that relative dimensions in FIGS. 2C and 2D are not necessarily to scale, but have been rendered for purposes of explanation only in describing the arrangement of the example eye-mountable electronic device 210. For example, the total thickness of the eye-mountable device can be about 200 micrometers, while the thickness of the tear-film layers 40, 42 can each be about 10 micrometers, although this ratio may not be reflected in the drawings. Some aspects are exaggerated to allow for illustration and facilitate explanation.

The eye 10 includes a cornea 20 that is covered by bringing the upper eyelid 30 and lower eyelid 32 together over the top of the eye 10. Incident light is received by the eye 10 through the cornea 20, where light is optically directed to light sensing elements of the eye 10 (e.g., rods and cones, etc.) to stimulate visual perception. The motion of the eyelids 30, 32 distributes a tear-film across the exposed corneal surface 22 of the eye 10. The tear-film is an aqueous solution secreted by the lacrimal gland to protect and lubricate the eye 10. When the eye-mountable device 210 is mounted in the eye 10, the tear-film may coat both the concave and convex surfaces 224, 226 with an inner layer 40 (along the concave surface 226) and an outer layer 42 (along the convex layer 224). The tear-film layers 40, 42 can be about 10 micrometers in thickness and together account for about 10 microliters.

The tear-film layers 40, 42 are distributed across the corneal surface 22 and/or the convex surface 224 by motion of the eyelids 30, 32. For example, the eyelids 30, 32 raise and lower, respectively, to spread a small volume of tear-film across the corneal surface 22 and/or the convex surface 224 of the eye-mountable device 210. The tear-film layer 40 on the corneal surface 22 also facilitates mounting the eye-mountable device 210 by capillary forces between the concave surface 226 and the corneal surface 22. In some examples, the eye-mountable device 210 can also be held over the eye in part by vacuum forces against corneal surface 22 due to the concave curvature of the eye-facing concave surface 226.

As shown in the cross-sectional views in FIGS. 2C and 2D, the substrate 230 can be inclined such that the flat mounting surfaces of the substrate 230 are approximately parallel to the adjacent portion of the convex surface 224. As described above, the substrate 230 may be a flattened ring with an inward-facing surface 232 (facing concave surface 226 of the polymeric material 220) and an outward-facing surface 234 (facing convex surface 224). The substrate 230 can have electronic components and/or patterned conductive materials mounted to either or both mounting surfaces 232, 234. As shown in FIG. 2D, the bio-interactive electronics 260, controller 250, and conductive interconnect 251 are mounted on the outward-facing surface 234 such that the bio-interactive electronics 260 are facing convex surface 224.

The polymer layer defining the anterior side of the eye-mountable device 210 of the eye—may be greater than 50 micrometers thick, whereas the polymer layer defining the posterior side of the eye-mountable device 210 may be less than 150 micrometers. Thus, bio-interactive electronics 260 may be at least 50 micrometers away from the convex surface 224 and may be a greater distance away from the concave surface 226. However, in other examples, the bio-interactive electronics 260 may be mounted on the inward-facing surface 232 of the substrate 230 such that the bio-interactive electronics 260 are facing concave surface 226. The bio-interactive electronics 260 could also be positioned closer to the concave surface 226 than the convex surface 224. With this arrangement shown in FIGS. 2C and 2D, the bio-interactive electronics 260 can receive analyte concentrations in the tear-film layer 42 through the channel 272.

III. EXAMPLE METHOD FOR PACKAGING AN ACTIVE EYE-MOUNTABLE DEVICE

Figure 3:
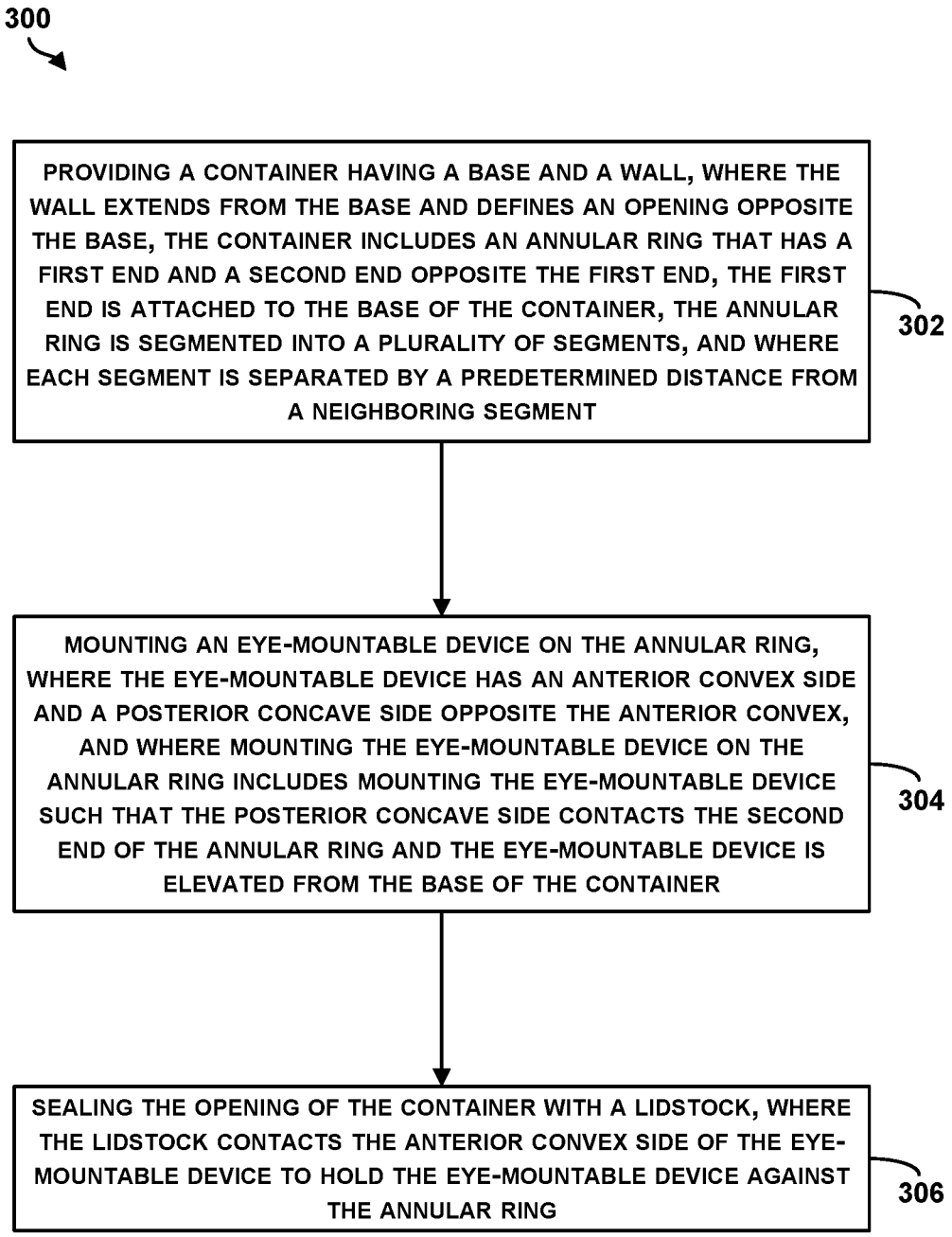
FIG. 3 is a flow chart of a method for packaging an eye-mountable device, in accordance with an example embodiment.

FIG. 3 is a flow chart of a method 300 for packaging an active eye-mountable device, in accordance with an example embodiment. The method 300 may include one or more operations, functions, or actions as illustrated by one or more of blocks 302-306. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

At block 302, the method 300 includes providing a container having a base and a wall, where the wall extends from the base and defines an opening opposite the base, the container includes an annular ring that has a first end and a second end opposite the first end, the first end is attached to the base of the container, the annular ring is segmented into a plurality of segments, and where each segment is separated by a predetermined distance from a neighboring segment.

Figure 4:
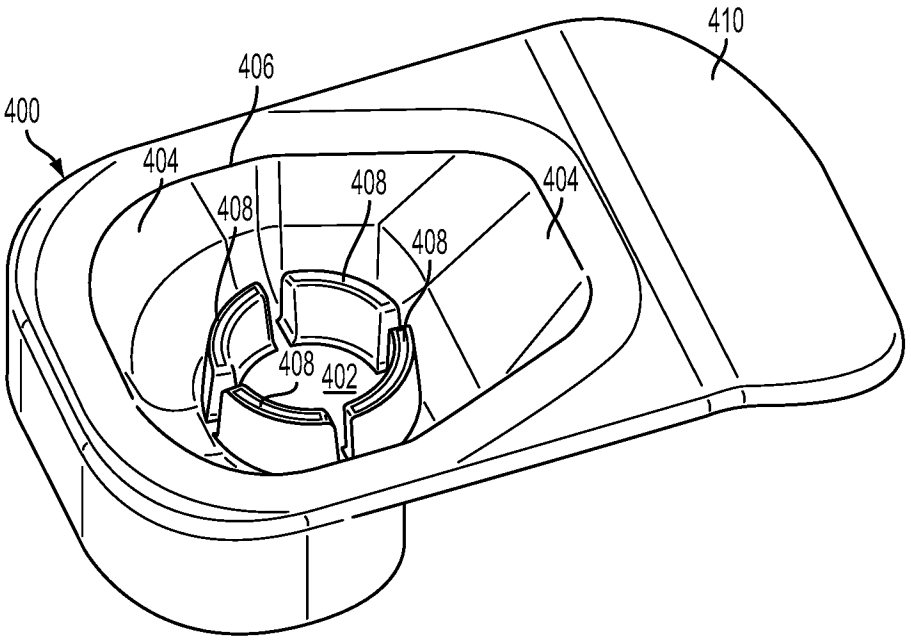
FIG. 4 illustrates a portion of a package including a container and an annular ring, in accordance with an example embodiment.

FIG. 4 illustrates a portion of a package including a container 400 and an annular ring, in accordance with an example embodiment. FIG. 4 depicts the container 400 having a base 402 and walls 404 that extend from the base 402 and define an opening 406. In an example, the container 400 may be made of a polymeric material. For instance, the polymer may include polyethylene terephthalate glycol, which is a thermoplastic polymer resin. However, other materials can be used as well. For example, the container 400 may be made of a polyolefin, such as polypropylene, or any other material (resilient or rigid).

FIG. 4 also depicts an annular ring disposed within the container 100 (in a cavity formed by the base 402 and the walls 404. The annular ring is divided into segments 408. Four segments 408 are shown in FIG. 4; however, the annular ring can be divided into any other number of segments. The annular ring has a first end attached to the base 402 of the container 400. The annular ring extends away from the base 402 of the container 400 and has a second end opposite the first end. Each segment 408 is separated by a predetermined distance from a neighboring segment so as to create gaps between the segments 408. FIG. 4 depicts an annular ring disposed within the container 100 to function as a support or a pedestal for an eye-mountable device to be mounted on the pedestal (as described below). However, the pedestal can take any form other than an annular ring. For instance, instead of an annular ring, a segmented hollow cylinder could be used. Any type of support or pedestal can be disposed within the container 100. Such pedestal may or may not be segmented, and may or may not be hollow. The annular ring described herein is an example for illustration only.

In one example, providing the container 400 may include forming the container 400. Forming the container 400 may involve injection molding or thermoforming or any other manufacturing process(es) appropriate for the material of the container 400. Example manufacturing processes that could be used to form the container 400 may include spinning inserting, implanting, gluing, laminating, hot pressing, rolling into, molding, stamping, lathing, milling, three-dimensional printing, or a combination thereof. In one example, the container 400 and the annular ring are formed separately, and the annular ring is inserted into the cavity of the container 400 where the first end of the annular ring is attached or coupled to the base 402 (e.g., via an adhesive or any other attachment technique). In another example, the container 400 and the annular ring are formed as one component or a single integral item via, for example, injection molding, or any other technique.

The container 400 may include other parts as well. For example, the container 400 depicted in FIG. 4 includes a handle 410 to facilitate gripping and moving the container 400. The container 400 may also include any other ergonomic components or parts that facilitate handling the container 400, positioning the container 400 in other packages, etc.

Referring back to FIG. 3, at block 304, the method 300 includes mounting an eye-mountable device on the annular ring, where the eye-mountable device has an anterior convex side and a posterior concave side opposite the anterior convex, and where mounting the eye-mountable device on the annular ring includes mounting the eye-mountable device such that the posterior concave side contacts the second end of the annular ring and the eye-mountable device is elevated from the base of the container.

Figure 5A:
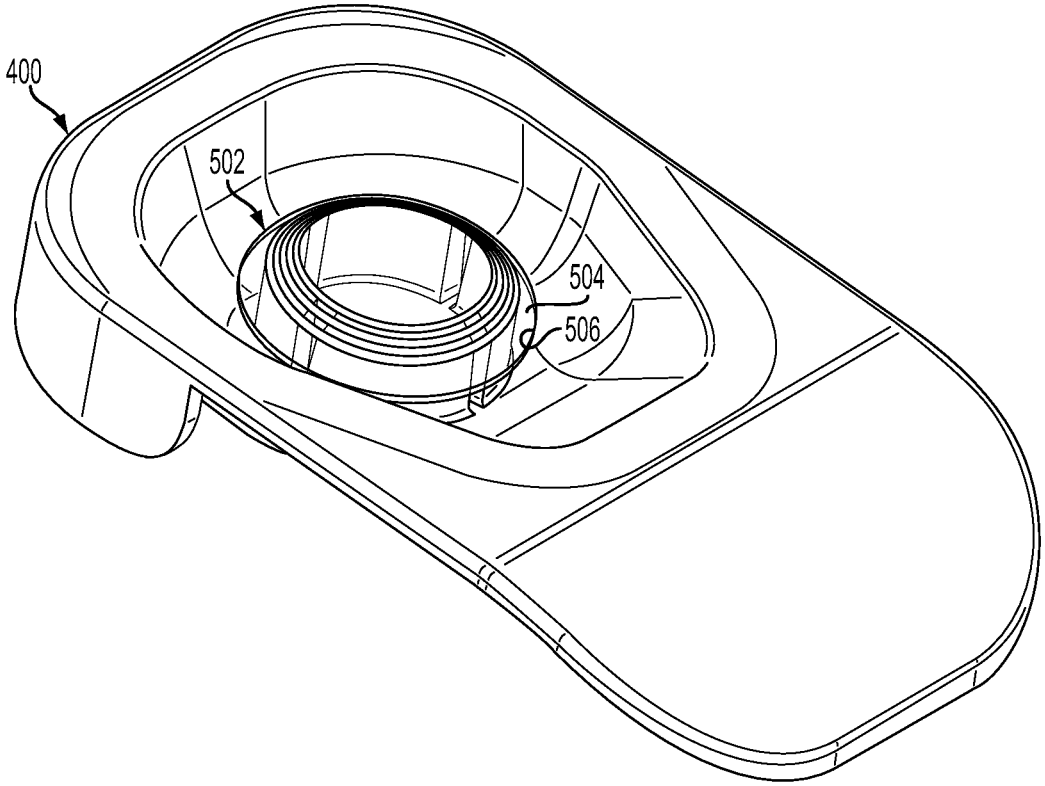
FIG. 5A illustrates a portion of the package including the container, the annular ring, and an eye-mountable device, in accordance with an example embodiment.
Figure 5B:
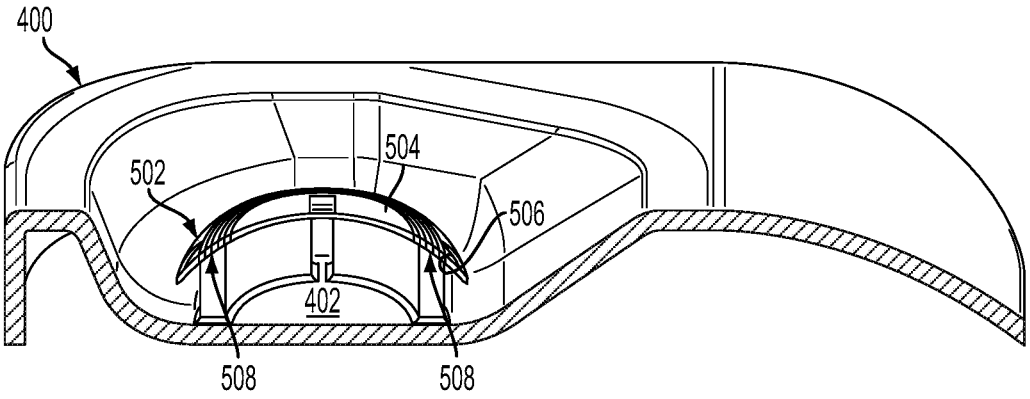
FIG. 5B illustrates a cross section of a side view of the portion illustrated in FIG. 5A, in accordance with an example embodiment.

FIG. 5A illustrates portion of the package including the container 400, the annular ring, and an eye-mountable device 502, in accordance with an example embodiment. The eye-mountable device 502 may, for example, be similar to the eye-mountable devices 110 and 210 described above. FIG. 5B illustrates a cross section of a side view of the portion illustrated in FIG. 5A, in accordance with an example embodiment. The cavity inside the container 400 forms a compartment of sufficient size to contain the eye-mountable device 502. FIGS. 5A-5B depict the eye-mountable device 502 having an anterior convex side 504 (similar to the convex surface 224 of the eye-mountable device 210) and a posterior concave side 506 (similar to the concave surface 226 of the eye-mountable device 210) opposite the anterior convex side 504. The eye-mountable device 502 is mounted on the annular ring such that the posterior concave side 504 contacts the second end of the annular ring and the eye-mountable device 502 is elevated from the base 402 of the container 400. In this manner, the annular ring is configured as a pedestal to support the eye-mountable device 502. To facilitate mounting the eye-mountable device 502 to the annular ring, the second end of the annular ring may have inclined surfaces 508 that conform to curvature of the posterior concave side 506 of the eye-mountable device 502. The material of the annular ring can be compatible with the material of the eye-mountable device 502, for example, to prevent scratching or abrasion between the annular ring and the posterior concave surface 506.

In examples, the eye-mountable device 502 may be supported by the annular ring in a specific orientation and is thus presented to a user in the specific orientation so that it can be handled properly, prepared properly, and to present sensors coupled to the eye-mountable device 502 in a correct orientation to facilitate calibration. The configuration shown in FIGS. 5A-5B ensures presenting the package to the user in a correct orientation where the sensors are facing a predetermined direction (outwardly or inwardly) based on type, function, and calibration method of a given sensor Referring back to FIG. 3, at block 306, the method 300 includes sealing the opening of the container with a lidstock, where the lidstock contacts the anterior convex side of the eye-mountable device to hold the eye-mountable device against the annular ring. In some examples, however, the lidstock may not contact the anterior convex side of the eye-mountable device. Rather, there may be a distance between the lidstock and the eye-mountable device. The distance may be sufficiently small so as to not let the eye-mountable device move (or substantially move) or fall off from atop the pedestal (e.g., the annular ring).

Figure 6:
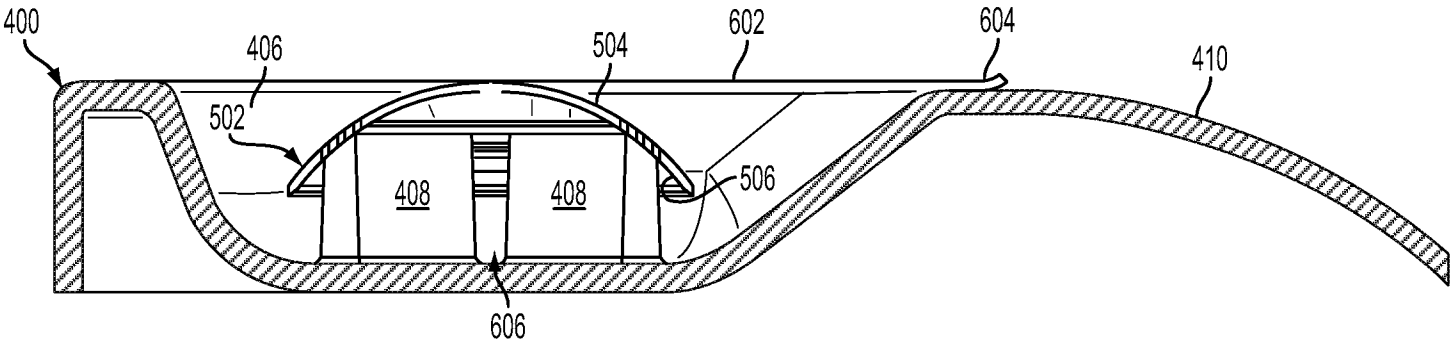
FIG. 6 illustrates a cross section of a side view of the package showing a lidstock, in accordance with an example embodiment.

FIG. 6 illustrates a cross section of a side view of the package showing a lidstock 602, in accordance with an example embodiment. FIG. 6 depicts the lidstock 602 configured to seal the opening 406 of the container 400. For instance, the lidstock 602 may be heat-sealed on the opening 406. The lidstock 602 may be coated with a heat-sealable adhesive material. Pressure can be applied to the lidstock 602 at a given temperature to affix the lidstock 602 to a rim of the opening 406. The opening 406 may have a flanged shape so as to facilitate sealing the opening 406 using the lidstock 602.

The lidstock 602 contacts and presses on the anterior convex side 504 of the eye-mountable device 502, and thus securely holds the eye-mountable device 502 against the annular ring as shown in FIG. 6. In this way, position of the eye-mountable device 502 is maintained in a manner that does not distort the shape of the eye-mountable device 502. Although FIG. 6 shows the lidstock 602 contacting the anterior convex side 504 of the eye-mountable device 502, in some example, as described above, there may be a distance between the lidstock 602 and the anterior convex side 504, where the distance is sufficiently small so as to not let the eye-mountable device move or fall off from atop the pedestal.

In one example, the lidstock 602 may be made of a Tyvek® material that contains high-density polyethylene fibers. The Tyvek® material may, for example, allow gas or vapor to permeate through the lidstock 602 but not liquids. In an example, the lidstock 602 may be made of a porous membrane configured to allow gas having molecules of a predetermined size to pass through the lidstock 602. The method 300 may further include causing a sterilizing gas, such as ethylene oxide, to permeate through the lidstock 602 to sterilize the container 400, the annular ring, and the eye-mountable device 502 while keeping the package intact. The porous membrane of the lidstock 602 may thus be configured to provide a moisture-resistant barrier to the package while allowing sterilizing gas to permeate through the lidstock 602 and sterilize the package. The package described and illustrated in FIGS. 3-6 can thus be a dry (i.e., substantially free of liquids), microbial-resistant, sterile enclosure suitable for the eye-mountable device 502 that may include a sensor having a biological enzyme or any other reagent included proximate thereto.

In an example, the lidstock 602 may include a tab portion 604. The tab portion 604 facilitates removing the lidstock 602 by a user when the use is ready to use the eye-mountable device 502. The tab portion 604 may be equipped with any feature that increases friction between user's fingers and the tab portion 604 to ensure a secure grip by the user during the process of opening the package (i.e., removing the lidstock 602).

As described above, in some examples, the eye-mountable device 502 may include at least one sensor configured to measure concentration of a given analyte. The eye-mountable device 502 may include a reagent (e.g., a biological enzyme such as glucose oxidase) localized proximate the electrochemical sensor so as to selectively react with an analyte in a tear-film. For example, when the eye-mountable device 502 is mounted to an eye of a user, the sensor may be configured to measure glucose concentration in a tear-film contacting the anterior convex side 504. Before the eye-mountable device 502 is mounted the eye of the user, the sensor may be calibrated so as to ensure accuracy of measurements captured by the sensor. The package depicted in FIGS. 4-6 is configured to facilitate such calibration.

When the package is received by a user, the lidstock 602 may be removed (e.g., by pulling the tab portion 604), and a calibration solution with a known concentration of an analyte of interest may be injected or poured in the container 400. The calibration solution could be, for example, an artificial solution with a composition that is similar to that of a normal tear-film. FIG. 6 shows segments 408 of the annular ring separated by a predetermined distance so as to create gaps 606 between the segments 408. The gaps 606 allow the calibration solution to fill the inside of the annular ring as well as the outside of the annular ring, where size of the gaps 606 control flow rate of the solution into the inside of the annular ring. Thus, the eye-mountable device 502 can be fully immersed in the calibration solution as the calibration solution contacts both the anterior convex side 504 as well as the posterior concave side 506. In this manner, the sensor can be calibrated properly while the eye-mountable device 502 is mounted on the annular ring.

The eye-mountable device 502 can be exposed to the calibration solution with the known analyte concentration and a sensor reading is obtained while the eye-mountable device 502 remains exposed. The sensor result (e.g., the amperometric current) divided by the concentration of the analyte can be set as the sensitivity of the eye-mountable device 502, and a linear relationship can be established with the sensitivity as the slope to relate future and/or past sensor results to analyte concentrations.

In some examples, the calibration process is initiated by signaling the external reader (e.g., the reader 180) to indicate the eye-mountable device 502 is exposed to the calibration solution with known analyte concentration. Such a signal can be generated by, for example, a user input. The external reader can emit radio frequency radiation to be harvested by the eye-mountable device 502 to power the sensor and control electronics to perform a sensor reading and communicate the result back to the external reader. The external reader can extract from the reading, a calibration value relating the sensor readings to analyte concentrations. That is, the calibration value can be a slope and/or intercept characterizing a linear relationship relating amperometric currents measured with the electrochemical sensor and analyte concentrations. Subsequent sensor readings when the eye-mountable device 502 is removed an mounted to an eye of the user can then be interpreted according to the calibrated relationship set by the sensor readings obtained with the calibration solution.

IV. CONCLUSION

Where example embodiments involve information related to a person or a device of a person, some embodiments may include privacy controls. Such privacy controls may include, at least, anonymization of device identifiers, transparency and user controls, including functionality that would enable users to modify or delete information relating to the user's use of a product.

Further, in situations in where embodiments discussed herein collect personal information about users, or may make use of personal information, the users may be provided with an opportunity to control whether programs or features collect user information (e.g., information about a user's medical history, social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may have control over how information is collected about the user and used by a content server.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

What is claimed is:

1. A method comprising:

providing a container having a base and a wall, wherein the wall extends from the base and defines an opening opposite the base, wherein the container includes a pedestal that has a first end and a second end opposite the first end, wherein the first end is attached to the base of the container;

mounting an eye-mountable device on the pedestal, wherein the eye-mountable device has an anterior convex side and a posterior concave side opposite the anterior convex, and wherein mounting the eye-mountable device on the pedestal comprises mounting the eyemountable device such that the posterior concave side contacts the second end of the pedestal and the eye-mountable device is elevated from the base of the container; and sealing the opening of the container with a lidstock such that the lidstock holds the eyemountable device against the pedestal without distorting a shape of the eye-mountable device and the container is substantially free of liquids.

2. The method of claim 1, further comprising:

forming the container from a polymeric material.

3. The method of claim 1, wherein the pedestal includes an annular ring segmented into a plurality of segments, and wherein each segment is separated by a predetermined distance from a neighboring segment.

4. The method of claim 1, wherein the lidstock is configured to contact the anterior convex side of the eye-mountable device to hold the eye-mountable device against the pedestal.

5. The method of claim 1, wherein the eye-mountable device includes a sensor configured to measure concentration of an analyte, wherein the sensor includes a reagent that selectively reacts with the analyte.

6. The method of claim 1, wherein the eye-mountable device includes a biological enzyme.

7. The method of claim 1, wherein the lidstock comprises a porous membrane configured to allow gas having molecules of a predetermined size to permeate through the lidstock while preventing liquids from permeating through the lidstock.

8. The method of claim 7, further comprising:

causing a sterilizing gas having molecules smaller than the predetermined size to permeate through the lidstock so as to sterilize an interior of the container including the eye-mountable device.

9. The method of claim 8, wherein the sterilizing gas comprises ethylene oxide.

10. The method of claim 1, wherein the container comprises a polymeric material.

11. The method of claim 10, wherein the polymeric material is polyethylene terephthalate glycol.

* * * * *